US007992219B2

(12) United States Patent
Bay

(10) Patent No.: US 7,992,219 B2
(45) Date of Patent: Aug. 9, 2011

(54) HYBRID MOTORSPORT GARMENT

(75) Inventor: Marc A. Bay, Farmington, MI (US)

(73) Assignee: Sullivans, Inc., Hanson, MA (US)

( * ) Notice: Subject to any disclaimer, the term of this patent is extended or adjusted under 35 U.S.C. 154(b) by 1527 days.

(21) Appl. No.: 11/079,914

(22) Filed: Mar. 14, 2005

(65) Prior Publication Data

US 2006/0200887 A1 Sep. 14, 2006

(51) Int. Cl.
*A41D 13/00* (2006.01)

(52) U.S. Cl. ..... 2/24; 602/16

(58) Field of Classification Search ..... 2/16, 22, 2/24, 62, 455, 79, 227, 911
See application file for complete search history.

(56) References Cited

U.S. PATENT DOCUMENTS

| | | | | |
|---|---|---|---|---|
| 4,420,895 | A * | 12/1983 | Baumann et al. | 36/118.2 |
| 4,953,543 | A | 9/1990 | Grim et al. | |
| 4,991,571 | A * | 2/1991 | Kausek | 602/16 |
| 5,107,823 | A * | 4/1992 | Fratesi | 602/16 |
| 5,373,584 | A * | 12/1994 | Parcells, III | 2/465 |
| 5,658,244 | A * | 8/1997 | Townsend et al. | 602/26 |
| 5,732,411 | A * | 3/1998 | Coleman et al. | 2/22 |
| 6,029,273 | A * | 2/2000 | McCrane | 2/24 |
| 6,129,690 | A | 10/2000 | Hamlin et al. | |
| 6,383,156 | B1 | 5/2002 | Enzerink et al. | |
| 6,510,560 | B1 * | 1/2003 | Ugolnik | 2/455 |
| 6,654,962 | B2 | 12/2003 | DeMott | |
| D492,068 | S | 6/2004 | Peterson et al. | |
| 6,751,804 | B1 | 6/2004 | Warner et al. | |
| 6,764,457 | B2 | 7/2004 | Hogg | |
| 6,789,264 | B2 * | 9/2004 | Budda | 2/22 |
| 6,795,974 | B1 * | 9/2004 | Howell | 2/22 |
| D498,344 | S | 11/2004 | Mazzarolo | |
| 6,817,029 | B2 | 11/2004 | Mazzarolo | |
| D500,395 | S | 12/2004 | Yang | |
| 6,964,062 | B1 * | 11/2005 | Chen | 2/22 |
| 7,204,819 | B2 * | 4/2007 | Berger | 602/26 |
| 2004/0181842 | A1 | 9/2004 | Mazzarolo | |

OTHER PUBLICATIONS

Joe Rocket. *Speedmaster Pant*. www.joerocket.com/jrf/products/product.cfm?products_id=393: pp. 1-2 (Feb. 14, 2005).
Joe Rocket. *Blaster Pant*. www.joerocket.com/jrf/products/product.cfm?products_id=438: pp. 1-2 (Feb. 14, 2005).
Joe Rocket. *GPX 2 Piece Suit*. www.joerocket.com/jrf/products/product.cfm?products_id=476: p. 1-2 (Feb. 14, 2005).
Joe Rocket. *Knee Slider*. www.joerocket.com/jrf/products/product.cfm?products_id=1015: p. 1 (Feb. 14, 2005).
Joe Rocket. *Stage 1 Pant*. www.joerocket.com/jrf/products/product.cfm?products_id=458: p. 1 (Feb. 14, 2005).
Joe Rocket. Speedmaster Suit. www.joerocket.com/jrf/products/product.cfm?products_id=378: p. 1-2 (Feb. 14, 2005).
Joe Rocket. *GPX 1 Piece Suit*. www.joerocket.com/jrf/products/product.cfm?products_id=379: p. 1-3 (Feb. 14, 2005).

(Continued)

*Primary Examiner* — Tejash Patel
(74) *Attorney, Agent, or Firm* — Cesari and McKenna, LLP

(57) ABSTRACT

A hybrid motorsport garment is provided. The garment includes at least one leg covering and a knee padding and protective assembly. The knee padding and protective assembly includes a knee frame and a cylindrical shaped object.

21 Claims, 12 Drawing Sheets

OTHER PUBLICATIONS

Joe Rocket. *Supermoto Pant*. www.joerocket.com/jrf/products/product.cfm?products_id=549: p. 1-2 (Feb. 14, 2005).
AXO. *TMP Knee Protectors*. http://www.epinions.com/auto-Motorsports-Accessories-All-AXO_TMP_Knee_Protectors: p. 1 (Mar. 10, 2005).
Innovation Sports. *Osteoarthritis bracing*. www.isports.com/oasys.htm: pp. 1-2 (Feb. 15, 2005).
Innovation Sports. *Rocket for Kids*. www.isports.com/rocket.htm: pp. 1-2 (Feb. 15, 2005).
Innovation Sports. *C180*. www.isports.com/c180.htm: pp. 1-2 (Feb. 15, 2005).
Innovation Sports. *Edge*. www.isports.com/edge.htm: pp. 1-2 (Feb. 15, 2005).
Innovation Sports. *Brace Yourself*. www.isports.com/byou.htm: p. 1 (Feb. 15, 2005).
Innovation Sports. *Bracing Works*. www.isports.com/bwor.htm: pp. 1-3 (Feb. 15, 2005).
EVS Knee Brace. http://froogle.goode.com/froogle?q=EVS+and+knee+brace&hl=en&Ir=8,sa=N&tab=ff&oi=froogler: pp. 1-2 (believe to have been published prior to Mar. 14, 2005).
2001 Kushitani Riding Equipment Collection Catalog (2001).

* cited by examiner

HYBRID MOTORSPORT GARMENT

BACKGROUND OF THE INVENTION

The present invention generally relates to a garment and more particularly to a hybrid motorsport garment.

Garments, such as pants and/or combined pants/jacket racing suits, are commonly used by people operating motorsport vehicles such as a motorcycle, all-terrain vehicle or snowmobile. Such pants and suits commonly employ at least one leg covering, and lower body anterior and posterior surfaces to cover a pelvic area of a rider's body. Such pants, however, do not provide adequate protection from side and/or front impacts to a leg, hyper-extending a knee area or other related leg injuries. Moreover, conventional pants restrict leg movement due to folds in the leg covering around the knee area. Furthermore, conventional pants do not incorporate a leg brace with a device for sliding on surfaces while turning corners.

SUMMARY OF THE INVENTION

In accordance with the present invention, a hybrid motorsport garment is provided. In another aspect of the present invention, a garment includes a leg covering and a knee padding and protective assembly. In a further aspect of the present invention, a knee padding and protection assembly includes a knee frame and a cylindrical shaped object. The knee frame is operative to reduce tearing or weakening of anterior and posterior ligaments, and to protect against impacts around a knee area of a leg. The frame extends from a femoral area to a shin area and covers the sides of the leg. The cylindrical shaped object is coupled to the frame and operative for sliding on the ground while cornering at high speeds, for example, on a motorcycle.

The present invention is advantageous over a traditional motorsport pant in that the present invention pivots with a rider's movement and reduces front and/or side impacts to the leg and hyper-extending of a knee area, which would otherwise cause knee related injuries. The present invention is further advantageous by providing energy-absorbing pads. Moreover, the present invention incorporates a knee slider often used by motorcycle racers. Additionally, the present invention reduces overall weight and bulk in comparison to a conventional motorsport protective pant by integrating the assembly into the pant and removing a portion of the pant beneath the assembly, while retaining the knee slider. Removing the portion of the pant beneath the assembly also allows the pant to have a more aerodynamic shape. Furthermore, the present invention provides increased leg movement by substantially reducing folds of material that restricted a rider's movement around the knee area and adding a set of hinge devices to the assembly. The present invention is also aesthetically fashionable and provides easy to use attachment devices, which effectively allows the rider to remove and replace such attachment devices as wear and tear occurs or as otherwise needed. Additional advantages and features of the present invention will become apparent from the following description and appended claims, taken in conjunction with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 4:
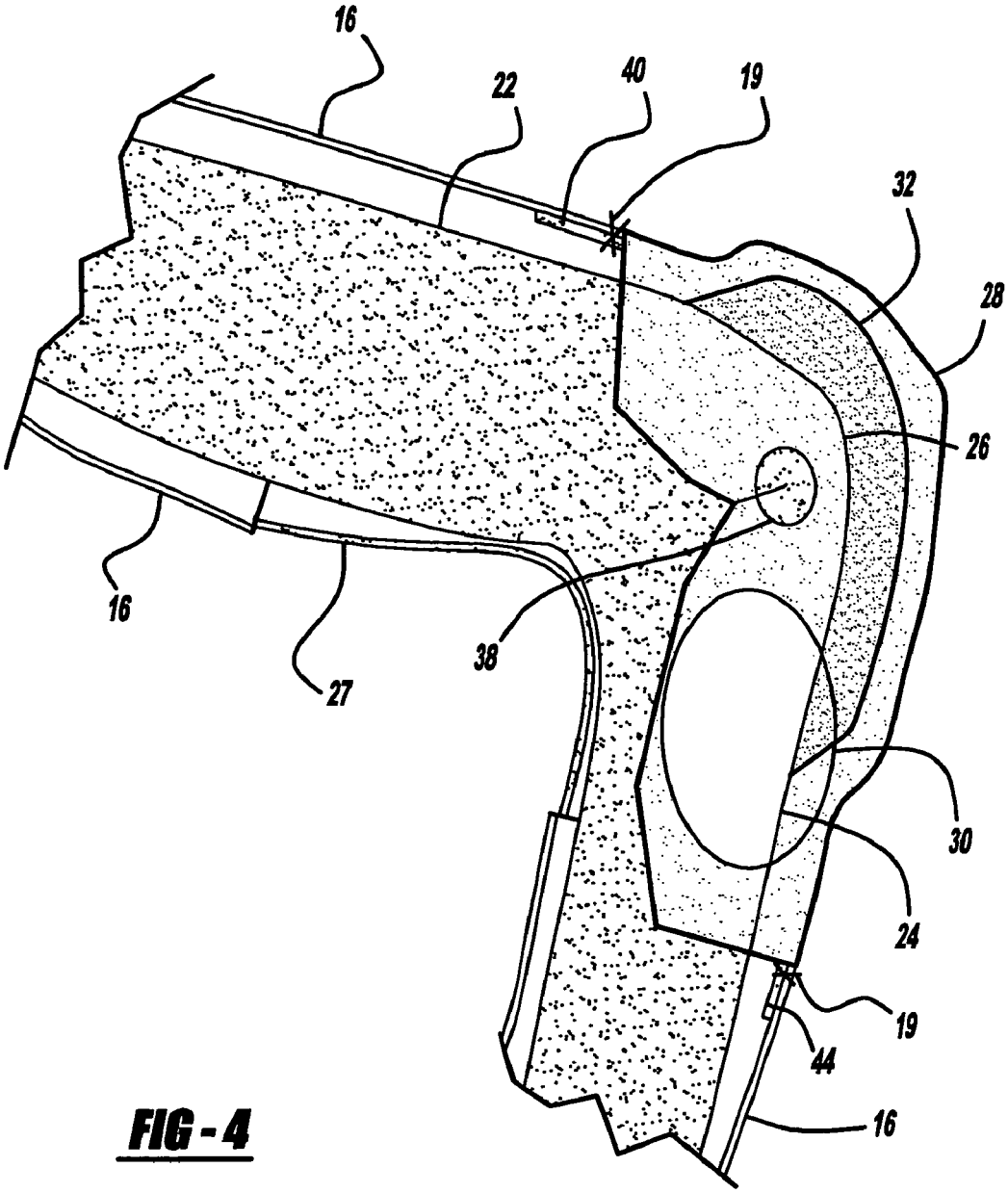
FIG. 4 is a side diagrammatic view illustrating a user's body in relation to the preferred embodiment garment.
Figure 5A:
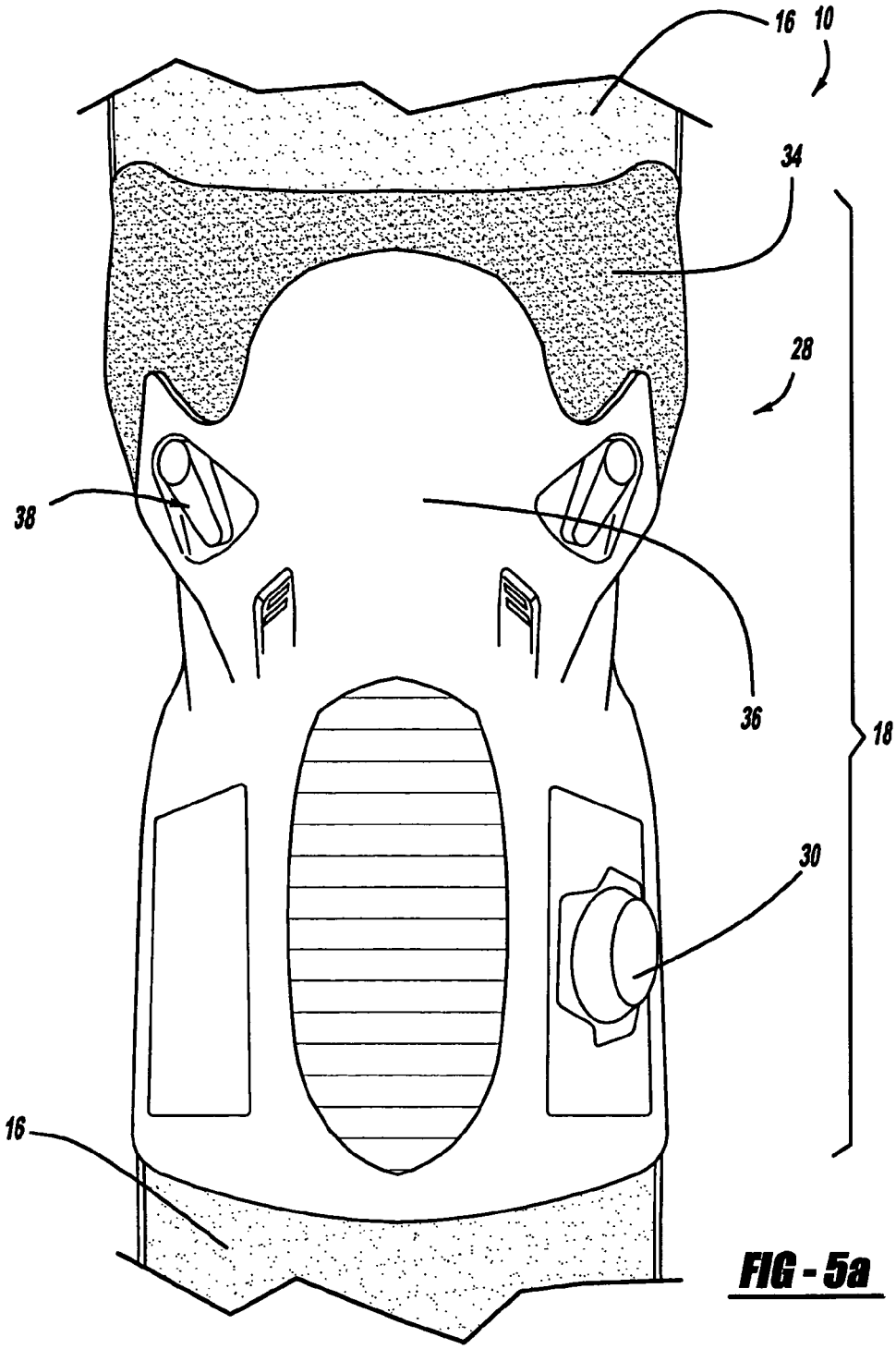
FIG. 5*a* is a front elevational view showing of the preferred embodiment garment.
Figure 5B:
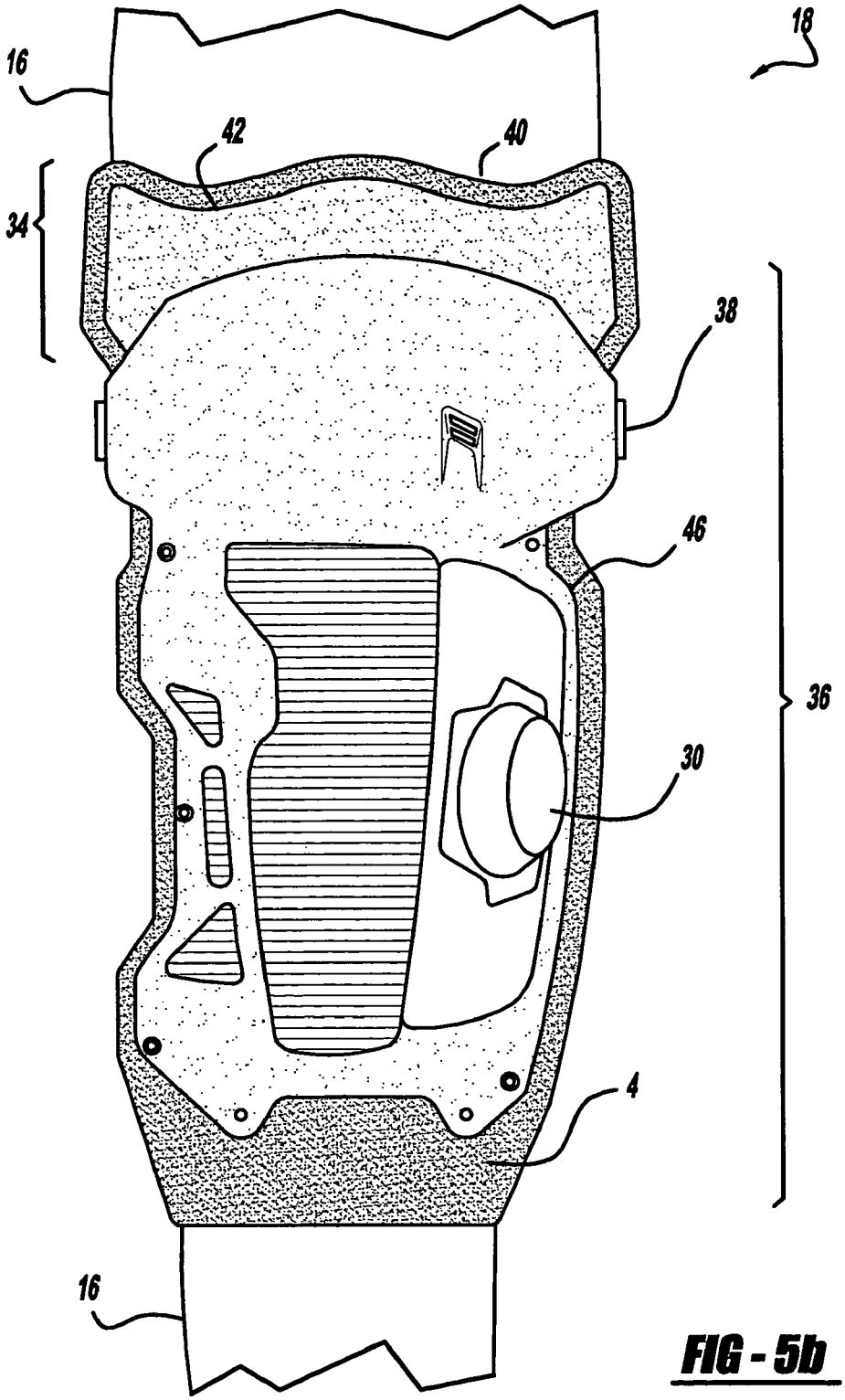
FIG. 5*b* is a front elevational view showing of an alternative embodiment garment of the present invention.

Referring to FIGS. 1-5 and 11, the preferred embodiment of a hybrid garment 10 of the present invention is worn by a rider 12 utilizing a motorcycle 14 or other motorized vehicle. Hybrid garment 10 is preferably a pant or a pant portion of a combined pant/jacket racing suit. Hybrid pant 10 includes at least one leg covering 16 having a parameter defining a hole and a knee padding and protection assembly 18. Leg covering 16 is made of a leather material. A preferred leather grade for the leg covering is 1.1 mm. Leg covering 16 is permanently coupled adjacent to the parameter of assembly 18 such that assembly 18 is coupled partly interior and partly exterior to leg covering 16. Assembly 18 is sewn to leg covering 16, as shown in FIG. 4 at 19. Leg covering 16 stops and assembly 18 begins within a femoral area 20 of a leg 22. Additionally, assembly 18 ends within a shin area 24 of leg 22, and leg covering 16 continues and extends to an ankle area of leg 22. Removing a portion of the leg covering to form the parameter defining the hole reduces bunching of leg covering 16 around a knee area 26 and decreases overall bulk and weight of leg covering 16. Additionally, this construction allows a direct contact between a user's body and assembly 18, which aids in increasing movement within knee area 26 of leg 22 without leg 22 hyper-extending. Leg covering 16 is constructed such that leg covering 16 and assembly 18 produce a tight and snug fit around leg 22 of rider 12. In addition to the leather material, leg covering also utilizes an elastic material 27 behind knee area 26 of leg 22 to further accomplish the tight and snug fit.

Figure 6:
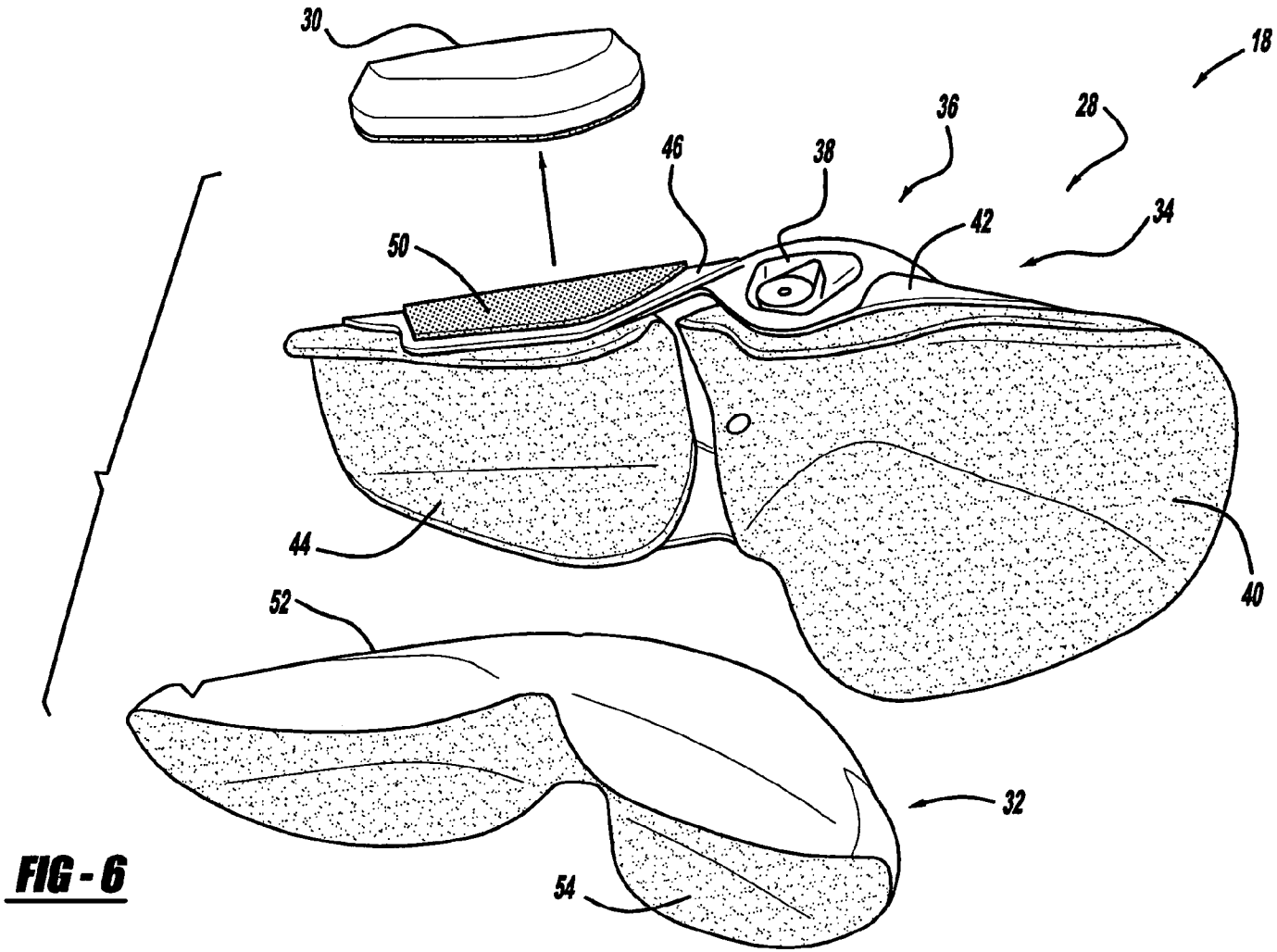
FIG. 6 is an exploded, rear perspective view showing a knee padding and protection assembly employed with the preferred embodiment garment.

FIGS. 4 and 6 illustrate knee padding and protection assembly 18 including a knee frame 28, a disk or cylindrical shaped object or device 30 and a crash, impact or energy absorbing pad 32. Knee frame 28 is coupled to cylindrical shaped object 30. Additionally, knee frame 28 is coupled to crash absorbing pad 32. Frame 28 is made of a polymeric material such that frame 28 is a rigid, unyielding and durable component. Frame 28 also reduces, if not prevents, tearing or weakening of anterior and posterior ligaments and protects against front and/or side impacts around knee area and a shin area 24 of rider 12. Frame 28 extends from femoral area 20 to shin area 24 of leg 22, as shown in FIG. 4.

FIGS. 2-3 and 5-11 show frame 28 including an upper assembly 34, a lower assembly 36 and a set of pivotal units or swivel devices 38. Upper assembly 34 comprises an upper padding 40 placed inside of an upper hard outer shell 42. Upper assembly 34 is positioned over femoral area 20 and knee area 26 and femoral area 20 of leg 22. Lower assembly 36 comprises a lower padding 44 placed inside of a lower hard outer shell 46. Knee padding and protection assembly 18 and leg covering 16 are coupled such that upper padding 40 and lower padding 44 are located inside of leg covering 16, as shown in FIG. 4. Additionally, lower assembly 36 extends from knee area 26 to shin area 24 of leg 22, such that upper assembly 34 and lower assembly 36 overlap within knee area 26. Upper hard outer shell 42 and lower hard outer shell 46 are made of any polymeric material that produces a rigid and durable outer shell to reduce impacts to the leg 22 and other knee related injuries to knee area 26 and shin area 24. Additionally, upper cushion section 40 and lower cushion section comprises foam, felt or any elastometric material which produces a soft padding. Set of pivotal units 38, such as a pair of hinge devices, couples upper assembly 34 to lower assembly 36. Set of pivotal units 38 enable movement and guiding of upper assembly 34 to lower assembly 36 for a plurality of knee positions. Additionally, set of pivotal units 38 provides an acute angular movement of upper assembly 34 relative to lower assembly 36. The preferred angular range of the frame is 80 to 170 degrees. This angular range is desirable to allow rider 12 relatively full movement of leg 22.

Figure 1:
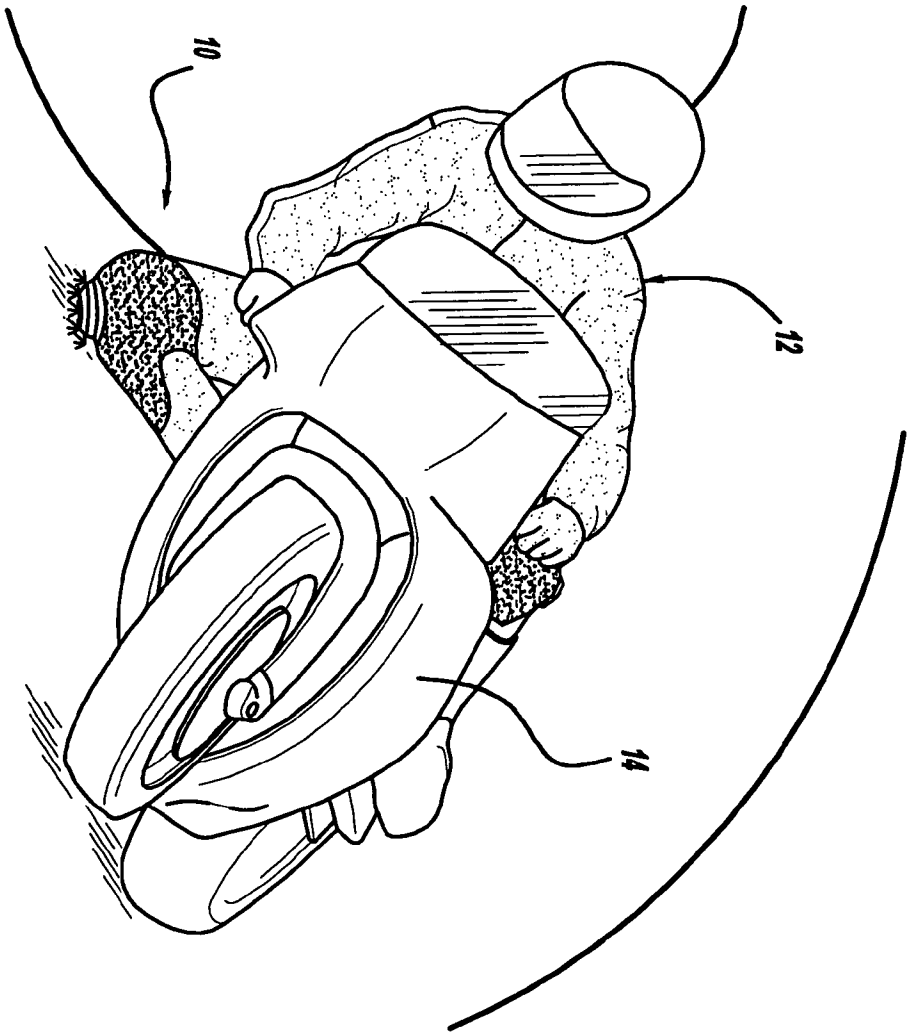
FIG. 1 is a perspective view showing the preferred embodiment of a hybrid slider and protective garment of the present invention, used by a rider on a motorcycle.
Figure 2:
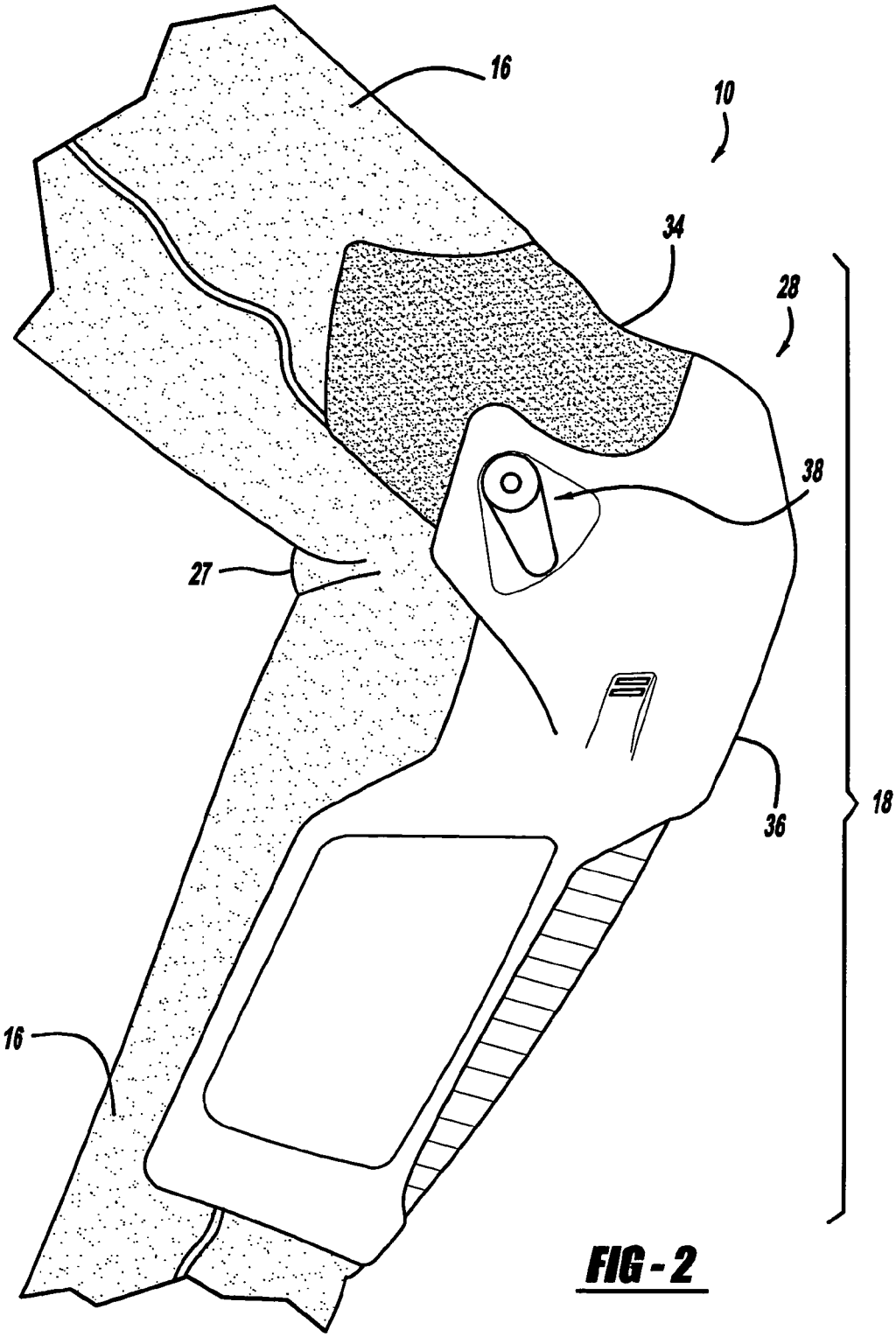
FIG. 2 is a right side elevational view showing the preferred embodiment garment of a left leg of a user.
Figure 3:
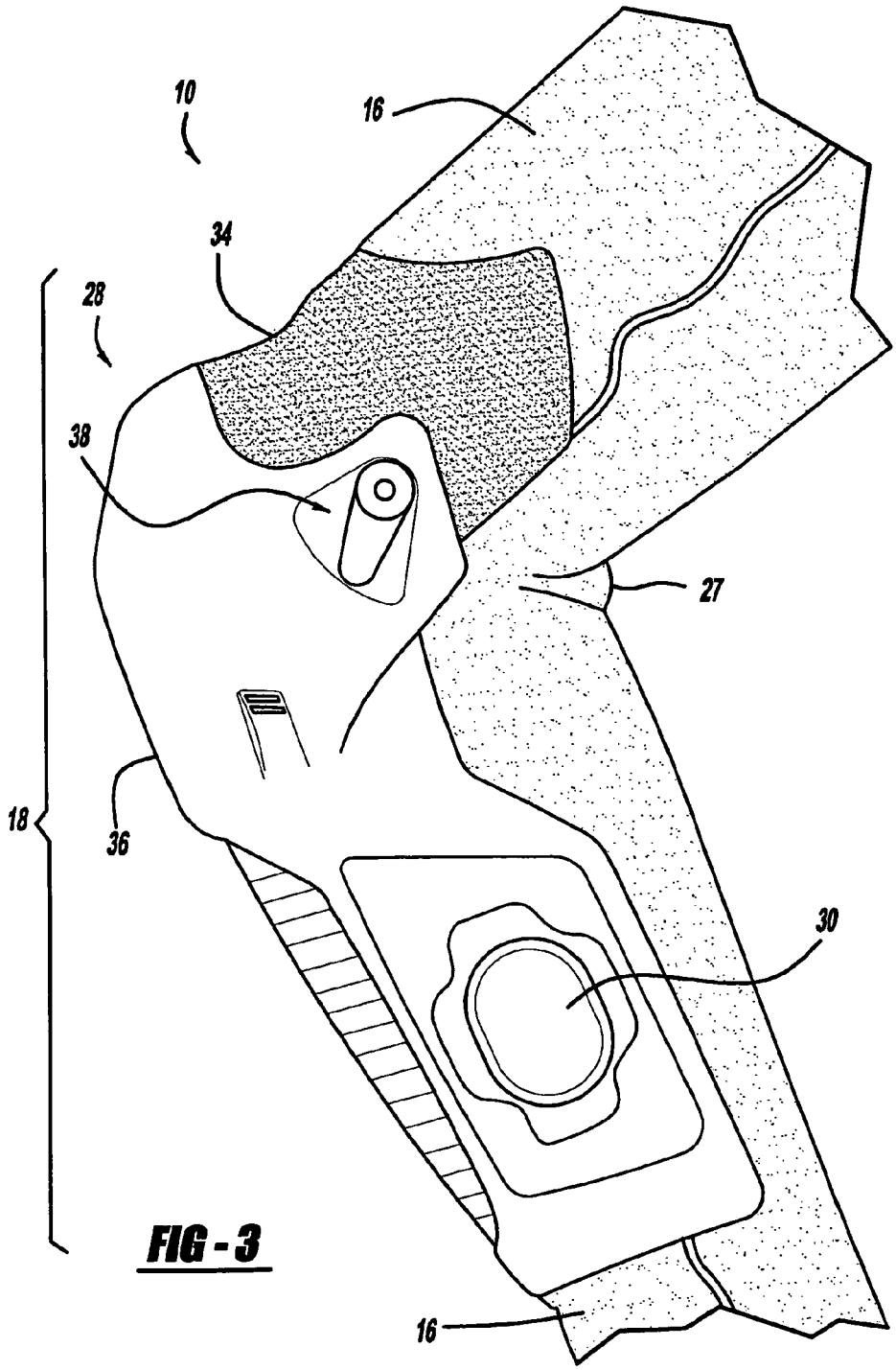
FIG. 3 is a left side elevational view showing of the preferred embodiment garment on a left leg of a user.

FIGS. 1, 3-7, 9 and 11 display cylindrical shaped object 30 placed on an outside of knee area 26 on lower assembly 36 of frame 28. Cylindrical shaped object 30 is used by rider 12 to slide on a surface, such as a road, while cornering at high speeds, as shown in FIG. 1. Cylindrical shaped object 30, such as a puck, is made of a hard ceramic and/or a polymeric material. However, cylindrical shaped object 30 may also be made of a wood and/or a leather material. In order to replace and remove cylindrical shaped object 30, due to wear and tear, cylindrical shaped object 30 is temporarily affixed to frame 28 via a hook and loop fastener 50.

As shown in FIGS. 4 and 6, crash absorbing pad 32, also known as body armor, is permanently coupled to frame 28 via a permanent attachment, such as adhesive. Additionally, crash absorbing pad 32 is seated within frame 28. Crash absorbing pad 32 absorbs energy and protects knee area 26 from impacts during use. Crash absorbing pad 32 is made of any elastomeric material, preferred examples of which include: natural rubbers; synthetic rubbers; rubber-like polymers and other rubber-like materials such that crash absorbing pad 32 includes a hard outer surface 52 and a cushioned or compressible inner portion 54. Crash absorbing pad 32 is injection molded in a three-dimensionally curved shape, such that knee area 26 of rider 12 rests comfortably as knee area 26 is bent.

Figure 7:
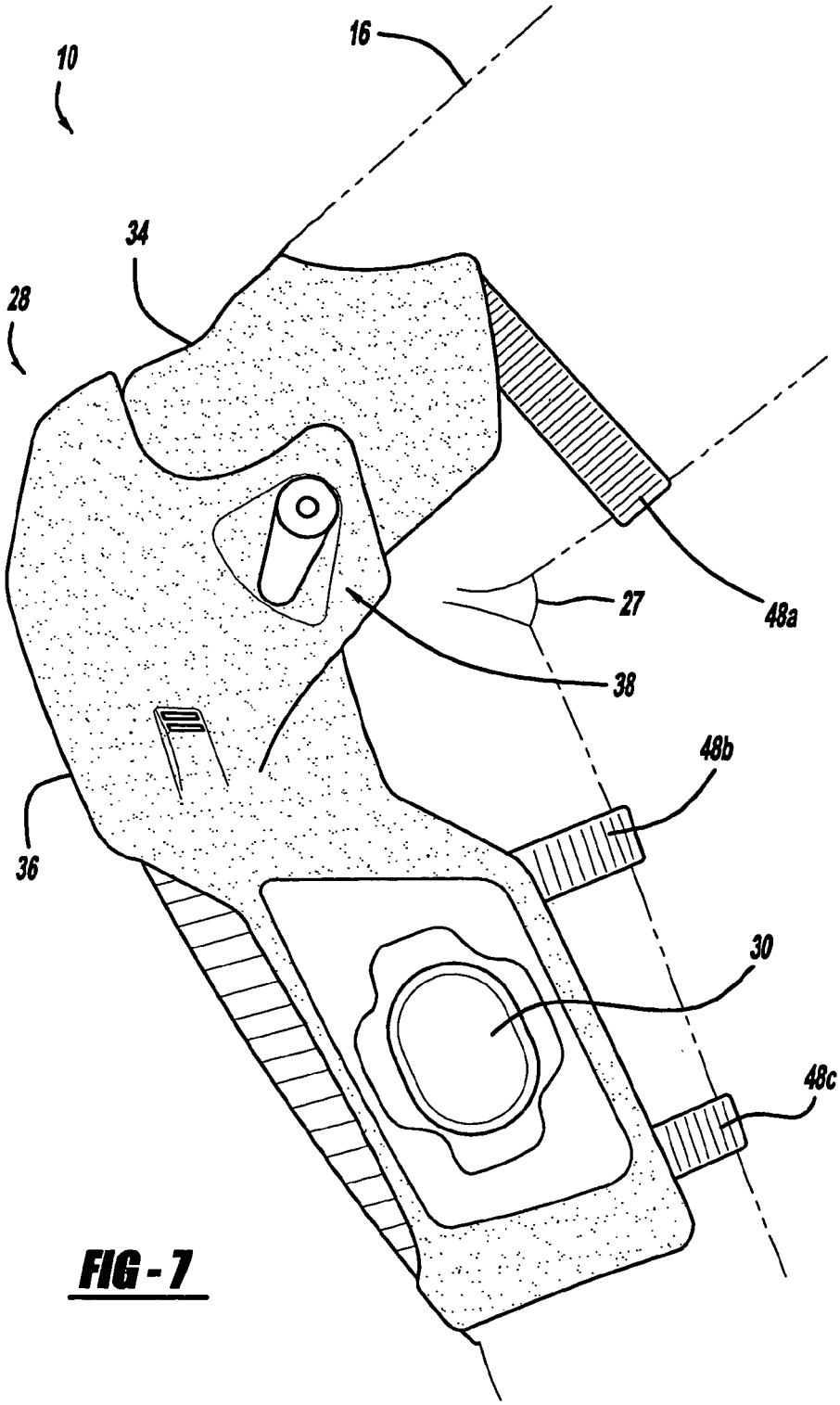
FIG. 7 is a left side elevational view showing the preferred embodiment garment with the securing device on a left leg of a user.
Figure 8:
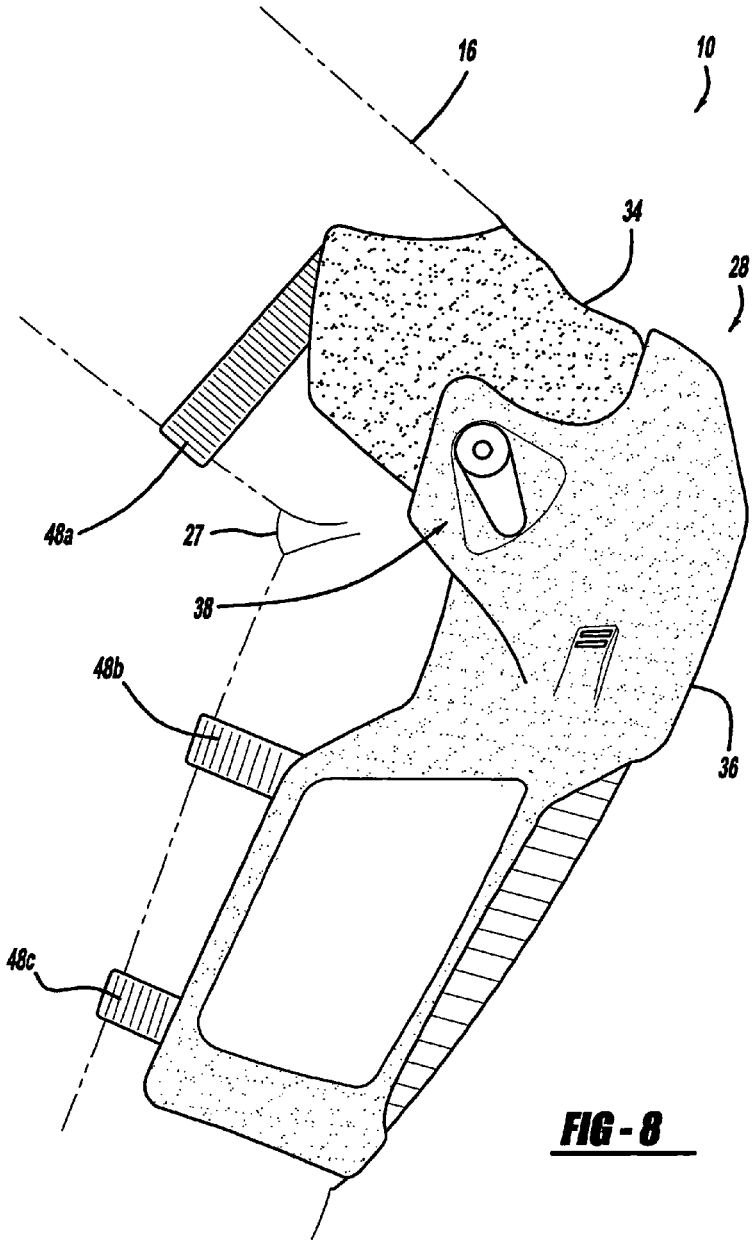
FIG. 8 is a right side elevational view showing the preferred embodiment garment with the securing device on a left leg of a user.
Figure 11:
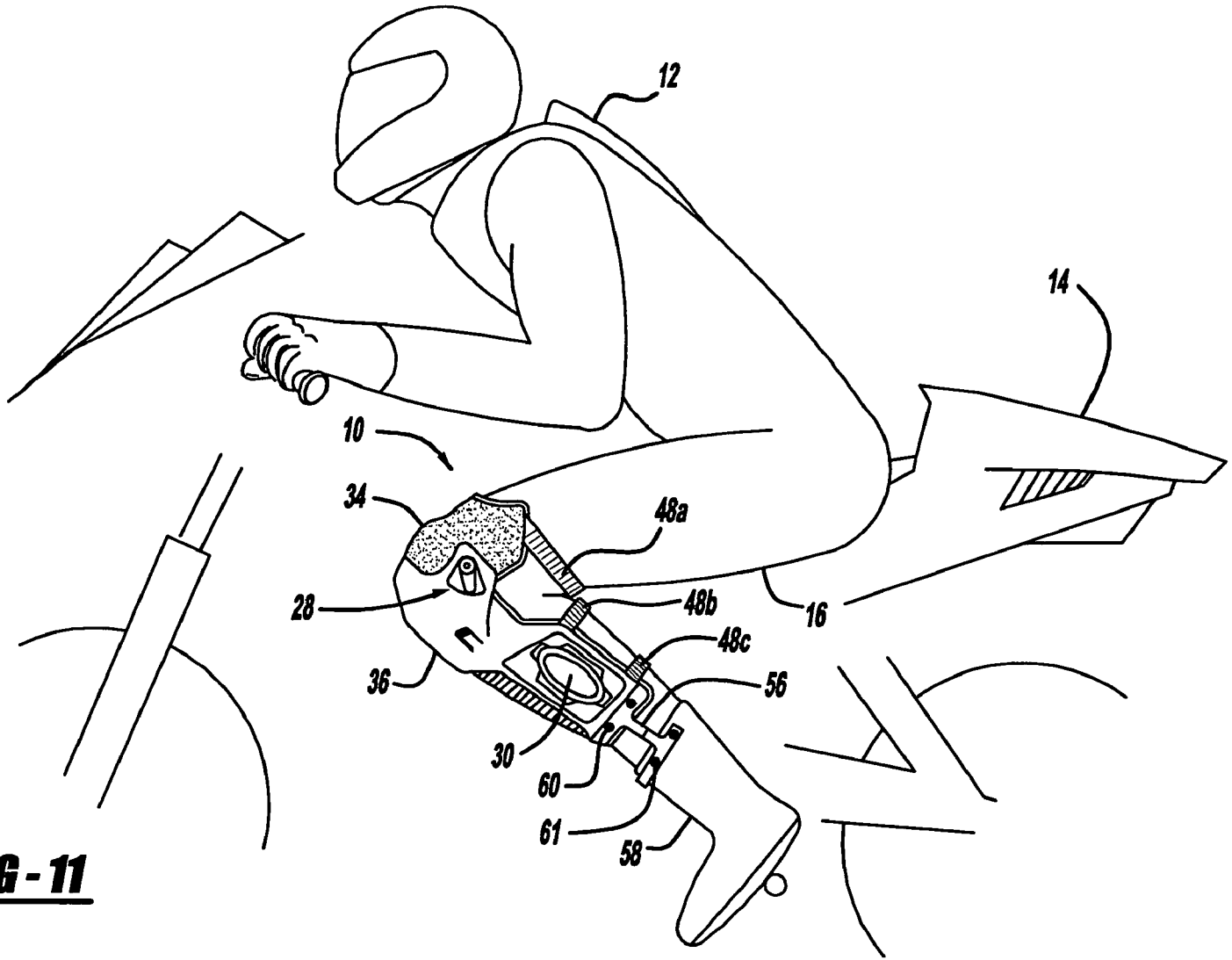
FIG. 11 is perspective view showing the preferred embodiment garment with the securing device and the extension device, used by a rider on a motorcycle.

In FIGS. 7-8 and 11, a securing device 48*a*, 48*b* and 48*c*, such as elastic or non-elastic straps, belts or bands, may optionally be used to add support around leg 22. A first strap 48*a* is coupled to upper assembly 34 of frame 28. First strap 48*a* extends circumferentially around femoral area 20 of leg 22. Additionally, a second strap 48*b* and a third strap 48*c* are coupled to lower assembly 36 of frame 28, such that second strap 48*b* is positioned above third strap 48*c*. Second strap 48*b* and third strap 48*c* extend circumferentially around a calf area of leg 22 below knee area 26. Additionally, non-elastic straps may be adjustable using a fastener, such as a hook and loop fastener, a buckle unit or a snapping device.

Figure 9:
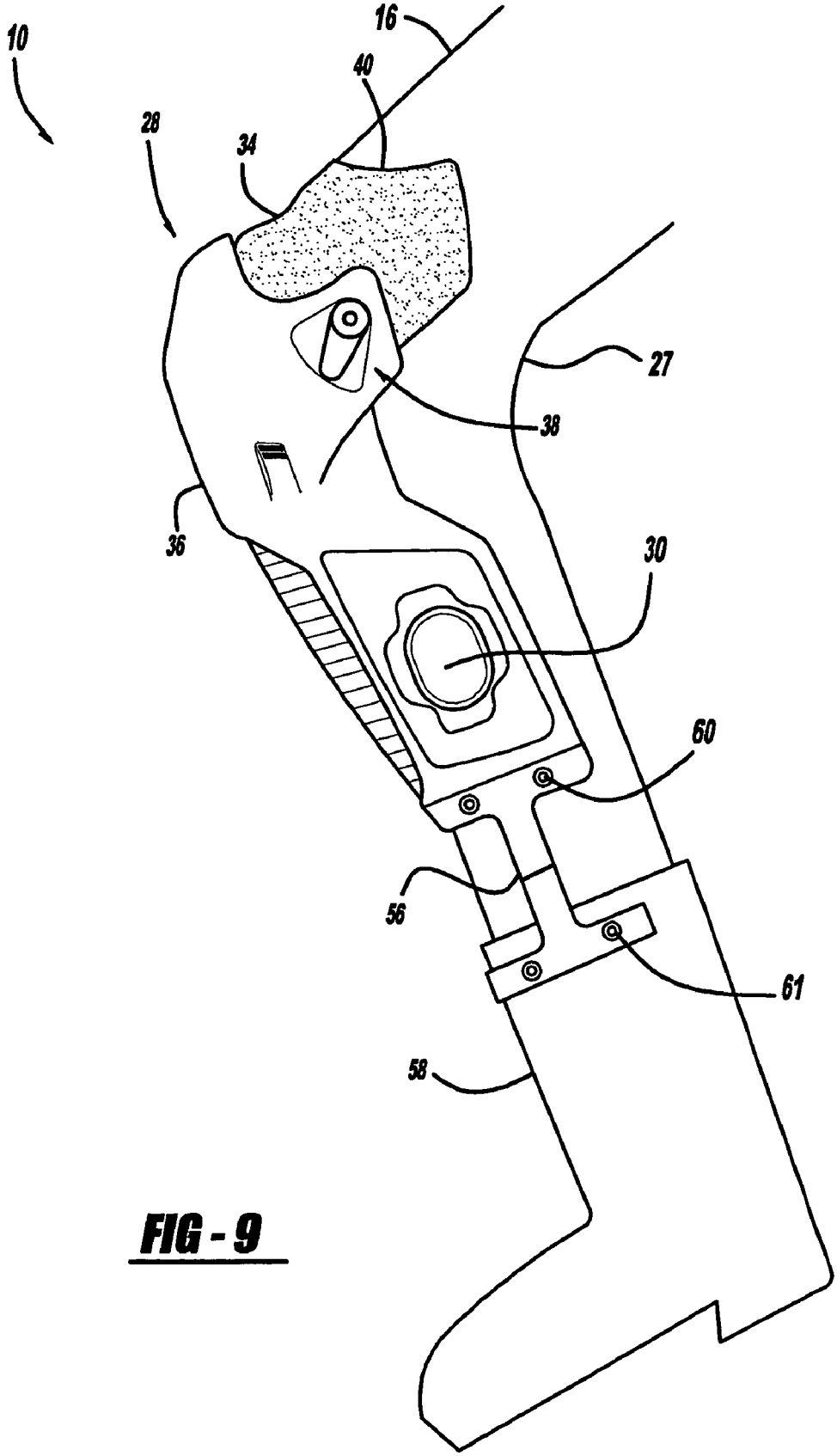
FIG. 9 is a left side elevational view showing the preferred embodiment garment with the securing device and an extension device coupled to a boot on a left leg of a user.
Figure 10:
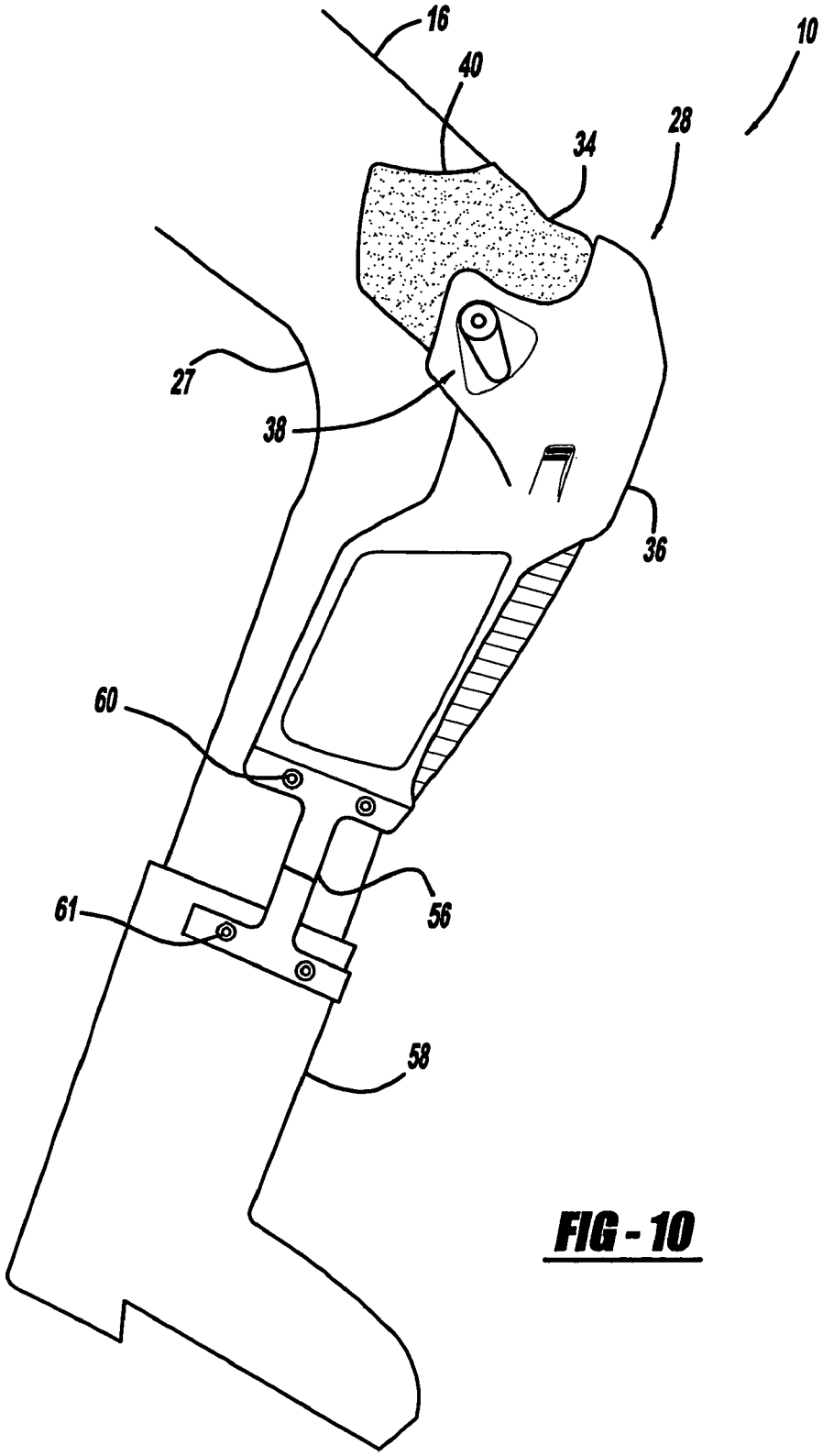
FIG. 10 is a right side elevation view showing the preferred embodiment garment with the securing device and the extension device coupled to a boot on a left leg of a user.

Optionally, an extension or bridge device 56 is coupled to frame 28 and a boot 58 of rider 12, as shown in FIGS. 9-11. Extension device 56 comprises an upper portion or unit, a lower portion or unit, at least one upper fastening device 60 and at least one lower fastening device 62. The at least one upper fastening device, such as a bolt and screw device, securely attaches extension device 56 to frame 28. Additionally, the at least one lower fastening device, such as a bolt and screw device, securely affixes to boot 58. Extension device 56 being telescopic extends and retracts by the lower portion sliding into the upper portion, which allows rider 12 to adjust and accommodate extension device 56 for different leg lengths, boot heights and different leg positions while riding a motorsport vehicle.

An alternative embodiment of the present invention includes knee padding and protection assembly 18 and securing device 48 without leg covering 16, although some advantages of the present invention may not be realized. Additionally, as stated above, extension device 56 may be optionally coupled to this alternative knee padding and protection assembly 18 and a boot.

Additionally, various aspects of the present invention have been disclosed, it should be appreciated that variations may be made without departing from the scope of the present invention. For example, securing device 48 may include a fabric portion, in addition to or instead of straps. The fabric portion may be coupled to assembly 18 in the preferred embodiment as well as the alternative embodiment. The fabric portion may fit circumferentially around leg 22 by providing a tightly snug fit, where rider 12 would slide leg 22 through the fabric portion to affix assembly 18 against leg 22 for a tightly snug fit. Alternatively, securing device 48 may include more or less than three straps for added support. Securing device 48 may also be permanently or temporally attached to assembly 18. Moreover, securing device 48 may be affixed to leg covering 16, instead of assembly 18. Additionally, knee padding and protection assembly 18 may be affixed on top of leg covering 16, preventing direct contact between the user's body and assembly 18. Furthermore, frame 28 may be permanently affixed to leg covering 16 via adhesive or some other permanent entity. Moreover, cylindrical shaped object 30 may be temporary adhered to frame 28 with or without a recess via a snap and lock feature and/or device, a twist and lock feature and/or device, a locking device, a buckle device, a button device, a tying device, a clipping device or any combination thereof. Cylindrical shaped object 30 may be positioned on upper assembly 34 or lower assembly 36 of frame 28. Furthermore, cylindrical shaped object 30 may take on additional shapes and forms, but provide the same function. Additionally, the material of leg covering 16 may include a synthetic material, a denim jean material, a textile fabric and/or any combination thereof. Moreover, leg covering 16 may also contain additional padding on the sides of knee area 26. Additionally, frame 28 may extend farther up femoral area 20 and/or down shin area 24. Frame 28 may also extend farther around the sides of leg 22 or may be reduced from the sides of the leg 22. Furthermore, crash absorbing pad 32 and frame 28 may include additional layers of cushion or additional pivotal units. Moreover, a zipper or multiple zippers may be coupled to leg covering 16 to produce a tighter fit of frame 28 to leg 22. Additionally, extension device 58 may be affixed to frame 28 or boot 58 via a fastener, clip device and/or snap device. It is also conceivable that the lower portion and the upper portion of extension device 56 may be interchangeable, such that the lower portion may be adaptable to couple to frame 28; likewise, the upper portion may be adaptable to couple to boot 58. Moreover, the upper or lower portion of extension device 56 may be permanently affixed to frame 28 or boot 58. Furthermore, the lower portion or upper portion of extension device 56 may be fused into boot 58 or frame 28, where extension 56 is incorporated into either frame 28 or boot 58. Additionally, FIGS. 2-11 show views of the present invention configured for a left leg of a rider, the present invention also may be configured for a right leg of a rider, wherein the hybrid motorsport garment 10 is a mirror image. One of ordinary skill in the art will appreciate that while the details descriptions herein regarding garment 10 may be particularly configured for the use of the left leg, one or more features of garment 10 can also be used for the right leg of a rider and the descriptions apply equally for each configurement of the invention. Moreover, various materials have been disclosed in an exemplary fashion, but other materials may of course be employed, although some of the advantages of the present invention may not be realized. It is intended by the following claims to cover these and any other departures from the disclosed embodiments, which fall within the true spirit of the invention.

What is claimed is:

1. A motorsport garment, comprising:

a leg covering portion configured to substantially cover a femoral area of a leg;

a knee frame portion coupled to the leg covering portion and configured to extend from substantially a femoral area to substantially a shin area of the leg;

a replaceable shaped object coupled to an exterior area of the knee frame portion, the replaceable shaped object operative for sliding on a ground surface while cornering on a motor vehicle; and a set of pivotal units that couple an upper portion of the knee frame portion and a lower portion of the knee frame portion, the set of pivotal units configured to provide an acute angular movement range of the upper portion of the knee frame portion with respect to the lower portion of the knee frame portion wherein the acute angular movement range is between approximately eighty and approximately one-hundred and seventy degrees, thereby preventing hyper-extension of a knee.

2. The motorsport garment of claim 1 wherein the upper portion of the knee frame portion comprises an upper hard outer shell and an upper cushion section, the upper portion of the knee frame portion being placed over the femoral area and a knee area of the leg, the upper hard outer shell being placed over the upper cushion section, and wherein a lower portion of the knee frame portion comprises a lower hard outer shell and a lower cushion section, the lower portion of the knee frame portion being placed over the knee area and the shin area of the leg, the lower hard outer shell being placed over the upper cushion section.

3. The motorsport garment of claim 1 wherein the set of pivotal units comprises one or more hinge devices that provide the acute angular movement of the upper portion of the knee frame portion relative to the lower portion of the knee frame portion.

4. The motorsport garment of claim 1 wherein the knee frame portion is permanently coupled to the leg covering portion.

5. The motorsport garment of claim 4 wherein the knee frame portion is sewn to the leg covering portion.

6. The motorsport garment of claim 1, further comprising a crash absorbing pad coupled to the knee frame portion and configured to absorb energy and reduce impacts to the knee area of the leg, the crash absorbing pad having a hard outer surface and a cushion inner portion, the cushion inner portion being coupled to and placed inside of the hard outer surface, and the crash absorbing pad being molded into a three-dimensionally shaped curve, wherein the crash absorbing pad substantially aligns with and substantially extends over the knee area of the leg.

7. The motorsport garment of claim 6 wherein the crash absorbing pad is permanently affixed to the knee frame portion.

8. The motorsport garment of claim 1 wherein the replaceable object comprises a material selected from a group consisting of ceramic, polymer, leather, wood and mixtures thereof.

9. The motorsport garment of claim 1 wherein the replaceable object is coupled to the exterior area of the knee frame portion by a hook and loop fastener.

10. The motorsport garment of claim 1 wherein the leg covering portion comprises a leather material, the leather material having an elastic material, wherein the elastic material being located behind the knee area of the leg covering portion such that the knee frame portion and the leg covering portion provide a snug fit around the leg.

11. The motorsport garment of claim 1, further comprising a bridge device configured to couple the motorsport garment to a boot of a rider.

12. The motorsport garment of claim 1 wherein the bridge device comprises a telescopic device adjustable to accommodated different leg lengths and positions while fastened to the boot.

13. The motorsport garment of claim 11, further comprising at least one band coupled to a lower portion of the motorsport garment, wherein the at least one band substantially extends circumferentially around the leg below the knee area of the leg.

14. The motorsport garment of claim 1, further comprising at least one band coupled to an upper portion of the motorsport garment, wherein the at least one band substantially extends circumferentially around a femoral area of the leg.

15. A motorsport garment, comprising:

a leg covering portion configured to substantially cover a femoral area of a leg;

a knee frame portion coupled to the leg covering portion and configured to extend from substantially a femoral area to substantially a shin area of the leg;

a replaceable shaped object coupled to an exterior area of the knee frame portion, the replaceable shaped object operative for sliding on a ground surface while cornering on a motor vehicle;

a set of pivotal units that couple an upper portion of the knee frame portion and a lower portion of the knee frame portion, the set of pivotal units configured to provide an acute angular movement range of the upper portion of the knee frame portion with respect to the lower portion of the knee frame portion wherein the acute angular movement range is between approximately eighty and approximately one-hundred and seventy degrees, thereby preventing hyper-extension of a knee; and an impact absorbing pad coupled to the motorsport garment, the impact absorbing pad comprising a hard outer surface and a compressible inner portion, the compressible inner portion being coupled to the hard outer surface, wherein the impact absorbing pad substantially aligns with and substantially extends over the knee area.

16. A motorsport garment, comprising:

a leg covering portion configured to substantially cover a femoral area of a leg;

a knee frame portion coupled to the leg covering portion and configured to extend from substantially a femoral area to substantially a shin area of the leg;

a replaceable shaped object coupled to an exterior area of the knee frame portion, the replaceable shaped object operative for sliding on a ground surface while cornering on a motor vehicle;

a set of pivotal units that couple an upper portion of the knee frame portion and a lower portion of the knee frame portion, the set of pivotal units configured to provide an acute angular movement range of the upper portion of the knee frame portion with respect to the lower portion of the knee frame portion wherein the acute angular movement range is between approximately eighty and approximately one-hundred and seventy degrees, thereby preventing hyper-extension of a knee; and a bridge device comprising an upper unit coupled to the knee frame portion and a lower unit coupled to a boot of a rider, the lower unit configured to slide within the upper unit adjusting for different leg lengths and leg positions when attached to the boot and the knee frame portion.

17. The motorsport garment of claim 16, further comprising at least one fastening device coupled to the upper unit and configured to securely affix the upper unit to the knee frame portion.

18. The device of claim 17 wherein the at least one fastening device comprises at least one bolt and screw unit.

19. The device of claim 17 further comprising at least one fastening device coupled to the lower unit and configured to securely adhere the lower unit to the boot.

20. The device of claim 19 wherein the at least one fastening device comprises at least one bolt and screw unit.

21. A motorsport garment, comprising:

a leg covering portion configured to substantially cover a femoral area of a leg;

a knee frame portion coupled to the leg covering portion and configured to extend from substantially a femoral area to substantially a shin area of the leg;

a replaceable shaped object coupled to an exterior area of the knee frame portion, the replaceable shaped object operative for sliding on a ground surface while cornering on a motor vehicle;

a set of pivotal units that couple an upper portion of the knee frame portion and a lower portion of the knee frame portion, the set of pivotal units configured to provide an acute angular movement range of the upper portion of the knee frame portion with respect to the lower portion of the knee frame portion wherein the acute angular movement range is between approximately eighty and approximately one-hundred and seventy degrees, thereby preventing hyper-extension of a knee;

an impact absorbing pad coupled to the motorsport garment, the impact absorbing pad comprising a hard outer surface and a compressible inner portion, the compressible inner portion being coupled to the hard outer surface, wherein the pad substantially aligns with and substantially extends over the knee area; and a bridge device comprising an upper unit coupled to the knee frame portion and a lower unit coupled to a boot of a rider, the lower unit configured to slide within the upper unit adjusting for different leg lengths and leg positions when attached to the boot and the knee frame portion.

* * * * *